US010398002B2

(12) United States Patent
Xu

(10) Patent No.: US 10,398,002 B2
(45) Date of Patent: Aug. 27, 2019

(54) BACKLIGHT MODULE, LCD AND BACKLIGHT MODULE DRIVING CONTROL METHOD

(71) Applicant: Wuhan China Star Optoelectronics Technology Co., Ltd., Wuhan, Hubei (CN)

(72) Inventor: Pengbo Xu, Guangdong (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 70 days.

(21) Appl. No.: 15/546,938

(22) PCT Filed: May 25, 2017

(86) PCT No.: PCT/CN2017/085923

§ 371 (c)(1),
(2) Date: Jul. 27, 2017

(87) PCT Pub. No.: WO2018/201537

PCT Pub. Date: Nov. 8, 2018

(65) Prior Publication Data

US 2018/0324923 A1 Nov. 8, 2018

(51) Int. Cl.
*H05B 33/08* (2006.01)

(52) U.S. Cl.
CPC ..... *H05B 33/0869* (2013.01); *H05B 33/0827* (2013.01)

(58) Field of Classification Search
CPC ..... H05B 33/0869; H05B 33/0827
See application file for complete search history.

(56) References Cited

U.S. PATENT DOCUMENTS

| | | | | |
|---|---|---|---|---|
| 2005/0141217 | A1 | 6/2005 | Kim | |
| 2014/0139499 | A1* | 5/2014 | Hussain | H05B 33/0827 345/204 |
| 2017/0238392 | A1* | 8/2017 | Shearer | H05B 33/0854 315/153 |
| 2018/0286841 | A1* | 10/2018 | Makanoeich | H01L 25/167 |

FOREIGN PATENT DOCUMENTS

| | | | |
|---|---|---|---|
| CN | 101057175 | A | 10/2007 |
| CN | 101178874 | A | 5/2008 |
| CN | 100447850 | C | 12/2008 |
| CN | 101433129 | A | 5/2009 |
| CN | 101581853 | A | 11/2009 |
| CN | 101821669 | A | 9/2010 |
| CN | 103458591 | A | 12/2013 |
| CN | 106249473 | A | 12/2016 |
| JP | 2010128072 | A | 6/2010 |
| KR | 20070107891 | A | 11/2007 |

* cited by examiner

*Primary Examiner* — Sahlu Okebato
(74) *Attorney, Agent, or Firm* — Andrew C. Cheng

(57) ABSTRACT

A backlight module, LCD and backlight module driving control method are disclosed. The backlight module includes: a pulse width modulation (PWM) control circuit, a driving circuit, a first white LED set and a second white LED set; the PWM control circuit being connected to the driving circuit, and the driving circuit being connected to the first white LED set and the second white LED set respectively; the PWM control circuit being for controlling the driving circuit to drive the first white LED set and the second white LED set to emit light; in which the first white LED set and the second white LED set having different chroma.

11 Claims, 2 Drawing Sheets

BACKLIGHT MODULE, LCD AND BACKLIGHT MODULE DRIVING CONTROL METHOD

CROSS REFERENCE TO RELATED APPLICATIONS

This application claims the priority of Chinese Patent Application No. 201710313171.3, entitled "Backlight Module, LCD and Backlight Module Driving Control Method", filed on May 5, 2017, the disclosure of which is incorporated herein by reference in its entirety.

BACKGROUND OF THE INVENTION

1. Field of the Invention

The present invention relates to the field of display, and in particular to the field of backlight module, liquid crystal display (LCD) and backlight module driving control method.

2. The Related Arts

At present, the application of light-emitting diode (LED) to the backlight for the liquid crystal display (LCD) is becoming common. The LCD products with LED backlight conquer many users with the images of thin, light and environmentally friendly, and the LCD products with LED backlight are gradually becoming the mainstream.

The principle of emitting white light for the current LCD used as backlight for the LCD is as follows: a part of the blue light emitted by the chip is transformed into yellow light by a medium; and the blue light mixed with yellow light yields the white light. The white light generated by the LED backlight based on this approach will turn yellowish as the LED ages so that the brightness of the display is reduced and the color display shows a yellow tint.

SUMMARY OF THE INVENTION

The primary object of the present invention is to provide a backlight module, with adjustable chroma, able to improve the brightness reduction problem with the backlight module ageing, yellow-tint color display and improve the display quality.

Another object of the present invention is to provide a liquid crystal display (LCD) with the above backlight module.

Yet another object of the present invention is to provide a backlight module driving control method, able to adjust the chroma of the backlight module, and improve he brightness reduction problem with the backlight module ageing, yellow-tint color display and improve the display quality.

To achieve the aforementioned objects, the present invention provides the following technical solution.

The present invention provides a backlight module, comprising: a pulse width modulation (PWM) control circuit, a driving circuit, a first white LED set and a second white LED set; the PWM control circuit being connected to the driving circuit, and the driving circuit being connected to the first white LED set and the second white LED set respectively; the PWM control circuit being for controlling the driving circuit to drive the first white LED set and the second white LED set to emit light; wherein, the first white LED set and the second white LED set having different chroma.

According to an embodiment of the present invention, the backlight module further comprises a detection unit; the detection unit is for detecting a chroma information of a mixed light from the first white LED set and the second white LED set, and transmitting the chroma information to the PWM control circuit; based on the chroma information, the PWM control circuit controls the driving circuit so that the mixed light from the first white LED set and the second white LED set has a chroma within a preset threshold range.

According to an embodiment of the present invention, the PWM control circuit comprises a mutually independent first PWM control module and second PWM control module; the first PWM control module is for controlling the driving circuit to drive the first white LED set to emit light, and the second PWM control module is for controlling the driving circuit to drive the second white LED set to emit light.

According to an embodiment of the present invention, the first white LED set is an LED set with a bluish tendency, and the second white LED set is an LED set with a yellowish tendency.

According to an embodiment of the present invention, the first white LED set comprises a plurality of serially connected first white LEDs, and the second white LED set comprises a plurality of serially connected second white LEDs.

The present invention also provides a liquid crystal display (LCD), comprising: a display panel and a backlight module, the backlight module comprising: a pulse width modulation (PWM) control circuit, a driving circuit, a first white LED set and a second white LED set; the PWM control circuit being connected to the driving circuit, and the driving circuit being connected to the first white LED set and the second white LED set respectively; the PWM control circuit being for controlling the driving circuit to drive the first white LED set and the second white LED set to emit light; wherein, the first white LED set and the second white LED set having different chroma.

According to an embodiment of the present invention, the backlight module further comprises a detection unit; the detection unit is for detecting a chroma information of a mixed light from the first white LED set and the second white LED set, and transmitting the chroma information to the PWM control circuit; based on the chroma information, the PWM control circuit controls the driving circuit so that the mixed light from the first white LED set and the second white LED set has a chroma within a preset threshold range.

According to an embodiment of the present invention, the PWM control circuit comprises a mutually independent first PWM control module and second PWM control module; the first PWM control module is for controlling the driving circuit to drive the first white LED set to emit light, and the second PWM control module is for controlling the driving circuit to drive the second white LED set to emit light.

According to an embodiment of the present invention, the first white LED set is an LED set with a bluish tendency, and the second white LED set is an LED set with a yellowish tendency.

According to an embodiment of the present invention, the first white LED set comprises a plurality of serially connected first white LEDs, and the second white LED set comprises a plurality of serially connected second white LEDs.

The present invention also provides a backlight module driving control method, comprising:

a pulse width modulation (PWM) control circuit transmitting a PWM modulation signal to a driving circuit;

the driving circuit generating a first driving signal and a second driving signal according to the PWM modulation signal, and outputting the first driving signal and the second driving signal to a first white LED set and a second white LED set respectively to drive the first white LED set and the second white LED set to emit light.

According to an embodiment of the present invention, the step of a PWM control circuit transmitting a PWM modulation signal to a driving circuit further comprises:

a detection unit obtaining a chroma information of a mixed light from the first white LED set and the second white LED set, and transmitting the chroma information to the PWM control circuit;

based on the chroma information, the PWM control circuit generating the PWM modulation signal according to the chroma information, and transmitting the PWM modulation signal to the driving circuit; and the driving circuit generating a first driving signal and a second driving signal according to the PWM modulation signal, and outputting the first driving signal and the second driving signal to a first white LED set and a second white LED set respectively to drive the first white LED set and the second white LED set to emit light which, after mixing, having a chroma within a preset threshold range.

According to an embodiment of the present invention, the method further comprises: establishing a table of chroma change with respect to the PWM modulation signal width change in advance, the PWM control circuit confirms the PWM modulation signal width change according to the table and a difference between the chroma information and a median of the preset threshold range so as to generate the PWM modulation signal.

According to an embodiment of the present invention, the method further comprises: establishing a chroma value for the mixed light of the first white LED set and the second white LED set, and transmitting the chroma value to the PWM control circuit; the PWM control circuit generating the PWM modulation signal according to the chroma information, and transmitting the PWM modulation signal to the driving circuit; and the driving circuit generating a first driving signal and a second driving signal according to the PWM modulation signal, and outputting the first driving signal and the second driving signal to a first white LED set and a second white LED set respectively to drive the first white LED set and the second white LED set to emit light which, after mixing, having a chroma within a preset threshold range.

The present invention provides the following advantages:

The light source of the backlight module of the present invention comprises a first white LED set and a second white LED set; by using the PWM control circuit in the backlight module to control the driving circuit to drive the first white LED set and the second white LED set to emit light, the present invention achieves the adjustment of the chroma of the backlight module so as to improve the brightness reduction problems with backlight module ageing and yellow-tint color display, and improve the display quality.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort.

DETAILED DESCRIPTION OF THE PREFERRED EMBODIMENTS

To further explain the technical means and effect of the present invention, the following refers to embodiments and drawings for detailed description. Apparently, the described embodiments are merely some embodiments of the present invention, instead of all embodiments. All other embodiments based on embodiments in the present invention and obtained by those skilled in the art without departing from the creative work of the present invention are within the scope of the present invention.

The light source commonly used in the backlight module is white LEDs. The white LED can be divided into various combinations of Bchip+Y powder (blue chip+yellow phosphor) LED, Bchip+Yσ powder (blue chip+red and yellow fluorescent powder) LED, Bchip+RG powder (blue chip+red green fluorescent powder) LED, BGchip+R powder (blue and green light+red fluorescent powder) LED, and RGBchip (red and green blue chip) LED, with increasing color performance capacity as the order listed above.

The light color of the backlight module is often expressed with chroma and brightness. The chroma is used to evaluate chromatin stimulation, and the value is usually represented by chromatic coordinates. Generally, (x, y) is used to represent a color, called the chromatic coordinates. The NTSC (National Television Systems Committee) provides that the standard red chromatic coordinates are (0.67,0.33), the standard green chromatic coordinates are (0.21,0.71), and the standard blue chromatic coordinates are (0.14,0.08). Pure white chromatic coordinates are (0.33,0.33), and yellow color coordinates are roughly (0.48,0.52).

Figure 1:
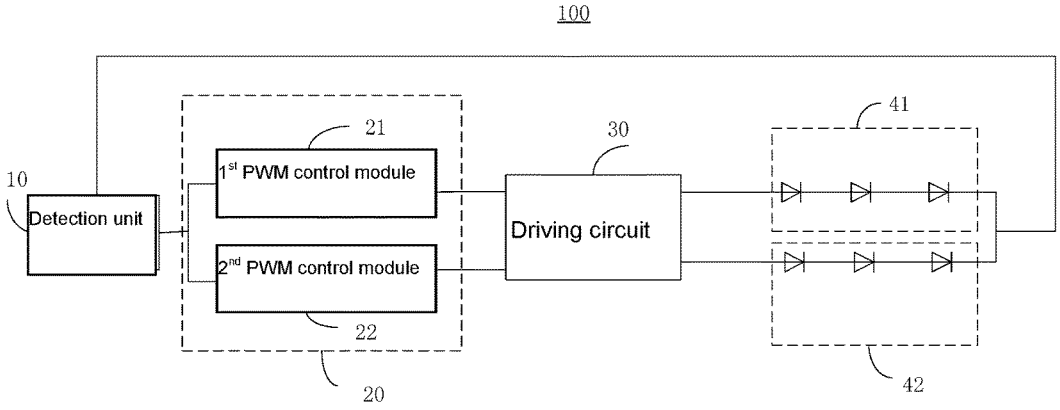
FIG. 1 is a schematic view showing the block diagram of the backlight module according to an embodiment of the present invention.

Refer to FIG. 1. FIG. 1 is a schematic view showing an embodiment of the backlight module of the present invention. The backlight module 100 comprises: a pulse width modulation (PWM) control circuit 20, a driving circuit 30, a first white LED set 41 and a second white LED set 42, and a light-guiding plate (not shown). The light emitted from the first white LED set 41 and the second white LED set 42 is mixed and enters the light-guiding plate. It should be understood that the backlight module also comprises other components, which are not the main focus of the present invention and the details are thus omitted.

The PWM changes the effective value of the backlight current by controlling the on-off time ratio for the backlight current, thereby to achieve the purpose of changing the brightness of the LED set; that is, the backlight current is either at the maximum, or is turned off. The PWM signal shows a good linearity with the duty cycle between the 100%-10%. Compared to analog dimming, the PWM can improve efficiency, and can avoid color shift when the current changes.

The PWM control circuit 20 comprises a mutually independent first PWM control module 21 and second PWM control module 22. The outputs of the first PWM control module 21 and the second PWM control module 22 are connected to the two inputs of the driving circuit 30 respectively. The driving circuit 30 further comprises a first output and a second output. The first output is connected to the first white LED set 41 and the second output is connected to the second white LED set 42. The PWM control circuit 20 (i.e., the first PWM control module 21 and the second PWM control module 22) performs as a switch, wherein, the first PWM control module 21 is for controlling the driving circuit 30 to drive the first white LED set 41 to emit light, and the second PWM control module 22 is for controlling the driving circuit 30 to drive the second white LED set 42 to emit light. The first white LED set 41 and the second white LED set 42 have different chroma.

Specifically, the chromatic coordinates of the light emitted by the first white LED set 41 are larger than the chromatic coordinates of the white light; and the chromatic coordinates of the light emitted by the second white LED set 42 are smaller than the chromatic coordinates of the white light. Preferably, t the first white LED set 41 is an LED set with a bluish tendency, and the second white LED set 42 is an LED set with a yellowish tendency.

More specifically, the first white LED set 41 comprises a plurality of serially connected first white LEDs. It should be understood that the plurality of first white LEDs have a bluish tendency. The second white LED set 42 comprises a plurality of serially connected second white LEDs. It should be understood that the plurality of second white LEDs have a yellowish tendency.

The light source of the backlight module of the present invention comprises the first white LED set 41 and the second white LED set 42; by using the PWM control circuit 20 in the backlight module to control the driving circuit 30 to drive the first white LED set 41 and the second white LED set 42 to emit light, the present invention achieves the adjustment of the chroma of the backlight module so as to improve the brightness reduction problems with backlight module ageing and yellow-tint color display, and improve the display quality.

According to an embodiment of the present invention, the backlight module further comprises a detection unit 10; the detection unit 10 is for detecting a chroma information of a mixed light from the first white LED set 41 and the second white LED set 24, and transmitting the chroma information to the PWM control circuit 20. The PWM control circuit 20 analyzes the chroma information and outputs the PWM modulation signal to the drive circuit 30 by the first PWM control module 21 and the second PWM control module 22, respectively. Then, the first PWM control module 21 and the second PWM control module 22 respectively control the driving circuit 30 so as to adjust the light emission of the first white LED set 41 and the second white LED set 42 so that the light from the first white LED set 41 and the second white LED set 42, after mixed, is within a preset threshold range. In a possible embodiment of the present invention, the median of the preset thresholds may be a pure white light chroma value.

Preferably, the detection unit 10 of the present invention is a sensor module that can be used directly or indirectly in detecting the chroma value of a light.

Figure 2:
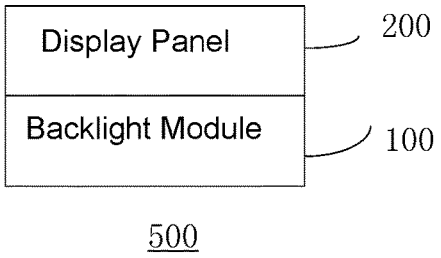
FIG. 2 is a schematic view showing the structure of the LCD of the present invention.

Refer to FIG. 2. FIG. 2 shows a schematic view of a liquid crystal display (LCD) of the present invention. The present invention also provides an LCD 500, comprising: a display panel 200 and a backlight module 100. The backlight module is as described in the above embodiments. The display panel 200 and the backlight module 100 are stacked, and the backlight module 100 provides backlight source to the display panel 200. It should be understood that the LCD can be applied to, such as, cell phones, tablet PC, TV, handheld computers, and so on.

Figure 3:
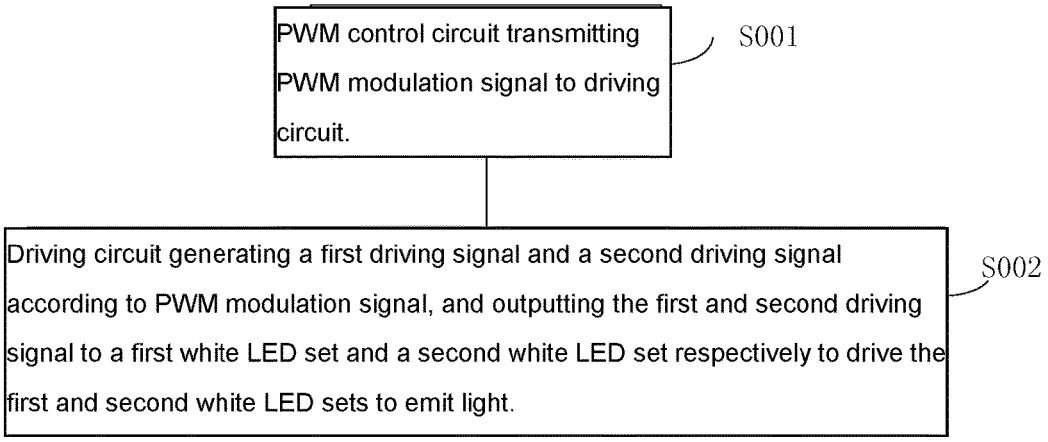
FIG. 3 is a schematic view showing the flowchart of the backlight module driving control method of the present invention.

Refer to FIG. 3. FIG. 3 shows a flowchart of the backlight module driving control method of the present invention. The present invention also provides a backlight module driving control method, comprising the following steps:

Step S001: a pulse width modulation (PWM) control circuit transmitting a PWM modulation signal to a driving circuit.

Specifically, according to an embodiment of the present invention, the adjustment can be performed by automatic control. For example, the backlight module 100 further comprises a detection unit 10. The detection unit 10 is for obtaining a chroma information of a mixed light from the first white LED set 41 and the second white LED set 42, and transmitting the chroma information to the PWM control circuit 20. The PWM control circuit 20 comprises a mutually independent first PWM control module 21 and second PWM control module 22. The PWM control circuit 20 (i.e., the first PWM control module 21 and the second PWM control module 22) performs analysis after receiving the chroma information. For example, a table of chroma change with respect to the PWM modulation signal width change is established in advance. The first PWM control module 21 and the second PWM control module 22 confirm the pulse width of the PWM modulation signal transmitted by first PWM control module 21 to the driving circuit 30 and the pulse width of the PWM modulation signal transmitted by second PWM control module 22 to the driving circuit 30 according to the table and a difference between the chroma information and a median of the preset threshold range. In other words, the PWM control circuit 20 generates PWM modulation signal according to the chroma information obtained by the detection unit 10 and transmits the PWM modulation signal to the driving circuit 30.

Step S002: the driving circuit 30 generating a first driving signal and a second driving signal according to the PWM modulation signal, and outputting the first driving signal and the second driving signal to a first white LED set 41 and a second white LED set 42 respectively to drive the first white LED set 41 and the second white LED set 42 to emit light.

Specifically, the driving circuit 30 generates the first driving signal according to the pulse width of the PWM modulation signal generated by the first PWM control module 21, and the driving circuit 30 generates the second driving signal according to the pulse width of the PWM modulation signal generated by the second PWM control module 22. The driving circuit 30 outputs correspondingly the first driving signal to the first white LED set 41 and the second driving signal to the second white LED set 42 so that the light from the first white LED set 41 and the second white LED set 42, after mixing, has a chroma within a preset threshold range. In a possible embodiment, the median of the preset threshold range is a chroma value of a pure white light.

For example, when the detection unit 10 detects that the light emitted from the backlight module has a yellowish tendency, the detection unit 10 transmits the detected chroma information to the first PWM control module 21 and the second PWM control module 22. The he first PWM control module 21 and the second PWM control module 22 simultaneously read the pre-stored table of chroma change with respect to the PWM modulation signal width change, and increases the pulse width of the PWM modulation signal transmitted to the driving circuit 30 by the first PWM control module 21 and/or reduce the pulse width of the PWM modulation signal transmitted to the driving circuit 30 by the second PWM control module 22. The driving circuit 30 receives the PWM modulation signal generated by the PWM control circuit 20 to generate and output the first drive signal and the second drive signal to the first white LED set 41 and the second white LED set 42, respectively, so as to control the light from the first white LED set 41 and the second white LED set 42, after mixing, has a chroma within a preset threshold range. It should be understood that when the detection unit 10 detects that the light emitted by the backlight module is bluish, it is possible to reduce the pulse width of the PWM modulation signal transmitted to the drive circuit 30 by the first PWM control module 21 and/or increase the pulse width of the PWM modulation signal transmitted to the drive circuit 30 by the second PWM control module 22 to adjust the light color of the mixed light from the first white LED set 41 and the second white LED set 42 to have the chroma within the preset threshold range.

In the backlight module driving control method of the present invention, by using the PWM control circuit to control the driving circuit, resulting in controlling the light emission of the first white LED set and the second white LED set, the object of chroma adjustment is achieved to improve the brightness reduction problems with backlight module ageing and yellowish color display and improve display quality.

In another possible embodiment of the present invention, the present provides a backlight module driving control method, comprising the following steps of:

Step S101: a pulse width modulation (PWM) control circuit transmitting a PWM modulation signal to a driving circuit.

Specifically, the method comprises the user to manually establish a chroma value for the mixed light of the first white LED set 41 and the second white LED set 42, for example, configuring the chroma value of the backlight module through the configuration module of the cell phone. The configuration module of the cell phone transmits the chroma value to the WPM control circuit 20. The PWM control circuit 20 generates and transmits the PWM modulation signal to the driving circuit 30 according to the chroma value.

Step S102: the driving circuit 30 generating a first driving signal and a second driving signal according to the PWM modulation signal, and outputting the first driving signal and the second driving signal to a first white LED set 41 and a second white LED set 42 respectively to drive the first white LED set 41 and the second white LED set 42 to emit light.

The driving circuit 30 generates a first driving signal and a second driving signal according to the PWM modulation signal, and outputs the first driving signal and the second driving signal to a first white LED set 41 and a second white LED set 42 respectively to drive the first white LED set 41 and the second white LED set 42 to emit light, which has a chroma value within the preset threshold range after mixing.

In the description of this specification, the description of the terms "one embodiment", "some embodiments", "examples", "specific examples" or "some examples" and the like means to incorporate the specific features described in the embodiment or example, structure, material, or characteristic included in at least one embodiment or example of the present invention. In the present specification, the schematic expression of the above-mentioned terminology does not necessarily refer to the same embodiment or example. Moreover, the particular features, structures, materials, or features described may be combined in any suitable embodiment or example in any suitable manner.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A backlight module, comprising: a pulse width modulation (PWM) control circuit, a driving circuit, a first white light-emitting diode (LED) set and a second white LED set; the PWM control circuit being connected to the driving circuit, and the driving circuit being connected to the first white LED set and the second white LED set respectively; the PWM control circuit controlling the driving circuit to drive the first white LED set and the second white LED set to emit first light and second light, respectively; wherein the first light of the first white LED set and the second light of the second white LED set have different chroma;

wherein a detection unit detects chroma information of mixed light of the first light of the first white LED set and the second light of the second white LED set and transmits the detected chroma information of the mixed light to the PWM control circuit such that based on the detected chroma information, the PWM control circuit controls the driving circuit to drive the first white LED set and the second white LED set to provide the mixed light with a chroma value that is within a preset threshold range.

2. The backlight module as claimed in claim 1, wherein the PWM control circuit comprises a mutually independent first PWM control module and second PWM control module; the first PWM control module is for controlling the driving circuit to drive the first white LED set to emit light, and the second PWM control module is for controlling the driving circuit to drive the second white LED set to emit light.

3. The backlight module as claimed in claim 1, wherein the first white LED set is an LED set with a bluish tendency, and the second white LED set is an LED set with a yellowish tendency.

4. The backlight module as claimed in claim 3, wherein the first white LED set comprises a plurality of serially connected first white LEDs, and the second white LED set comprises a plurality of serially connected second white LEDs.

5. A liquid crystal display (LCD), comprising: a display panel and a backlight module, the backlight module comprising: a pulse width modulation (PWM) control circuit, a driving circuit, a first white light-emitting diode (LED) set and a second white LED set; the PWM control circuit being connected to the driving circuit, and the driving circuit being connected to the first white LED set and the second white LED set respectively; the PWM control circuit controlling the driving circuit to drive the first white LED set and the second white LED set to emit first light and second light, respectively; wherein the first light of the first white LED set and the second light of the second white LED set have different chroma;

wherein a detection unit detects chroma information of mixed light of the first light of the first white LED set and the second light of the second white LED set and transmits the detected chroma information of the mixed light to the PWM control circuit such that based on the detected chroma information, the PWM control circuit controls the driving circuit to drive the first white LED set and the second white LED set to provide the mixed light with a chroma value that is within a preset threshold range.

6. The LCD as claimed in claim 5, wherein the PWM control circuit comprises a mutually independent first PWM control module and second PWM control module; the first PWM control module is for controlling the driving circuit to drive the first white LED set to emit light, and the second PWM control module is for controlling the driving circuit to drive the second white LED set to emit light.

7. The LCD as claimed in claim 5, wherein the first white LED set is an LED set with a bluish tendency, and the second white LED set is an LED set with a yellowish tendency.

8. The LCD as claimed in claim 7, wherein the first white LED set comprises a plurality of serially connected first white LEDs, and the second white LED set comprises a plurality of serially connected second white LEDs.

9. A backlight module driving control method, comprising:

a pulse width modulation (PWM) control circuit transmitting a PWM modulation signal to a driving circuit;

the driving circuit generating a first driving signal and a second driving signal according to the PWM modulation signal, and outputting the first driving signal and the second driving signal to a first white LED set and a second white LED set respectively to drive the first white LED set and the second white LED set to emit first light and second light, respectively;

wherein the step of a PWM control circuit transmitting a PWM modulation signal to a driving circuit further comprises:

a detection unit detecting chroma information of mixed light of the first light of the first white LED set and the second light of the second white LED set, and transmitting the detected chroma information to the PWM control circuit;

the PWM control circuit generating the PWM modulation signal according to the detected chroma information, and transmitting the PWM modulation signal to the driving circuit; and the driving circuit generating the first driving signal and the second driving signal according to the PWM modulation signal, and outputting the first driving signal and the second driving signal to the first white LED set and the second white LED set respectively to drive the first white LED set and the second white LED set to emit the first light and the second light, respectively, wherein the first light and the second light are mixed to provide the mixed light having chroma within a preset threshold range.

10. The backlight module driving control method as claimed in claim 9, wherein the method further comprises: establishing a table of chroma change with respect to the PWM modulation signal width change in advance, the PWM control circuit confirms the PWM modulation signal width change according to the table and a difference between the chroma information and a median of the preset threshold range so as to generate the PWM modulation signal.

11. The display panel as claimed in claim 9, wherein the method further comprises: establishing a chroma value for the mixed light of the first white LED set and the second white LED set, and transmitting the chroma value to the PWM control circuit; the PWM control circuit generating the PWM modulation signal according to the chroma information, and transmitting the PWM modulation signal to the driving circuit;

and the driving circuit generating a first driving signal and a second driving signal according to the PWM modulation signal, and outputting the first driving signal and the second driving signal to a first white LED set and a second white LED set respectively to drive the first white LED set and the second white LED set to emit light which, after mixing, having a chroma within a preset threshold range.

* * * * *